US009522092B2

(12) United States Patent
Goddert

(10) Patent No.: US 9,522,092 B2
(45) Date of Patent: Dec. 20, 2016

(54) BED FOR PROVIDING SUPPORT IN SITTING UP

(76) Inventor: Marco Goddert, Wurzburg (DE)

( * ) Notice: Subject to any disclaimer, the term of this patent is extended or adjusted under 35 U.S.C. 154(b) by 0 days.

(21) Appl. No.: 13/392,766

(22) PCT Filed: Aug. 12, 2010

(86) PCT No.: PCT/DE2010/000956

§ 371 (c)(1),
(2), (4) Date: May 11, 2012

(87) PCT Pub. No.: WO2011/023161

PCT Pub. Date: Mar. 3, 2011

(65) Prior Publication Data

US 2012/0266382 A1 Oct. 25, 2012

(30) Foreign Application Priority Data

Aug. 29, 2009 (DE) ..... 10 2009 039 367

(51) Int. Cl.
*A61G 7/00* (2006.01)
*A61G 7/015* (2006.01)
*A61G 7/053* (2006.01)

(52) U.S. Cl.
CPC ..... *A61G 7/001* (2013.01); *A61G 7/015* (2013.01); *A61G 7/053* (2013.01)

(58) Field of Classification Search
CPC ..... A61G 7/001; A61G 7/053; A61G 7/015
(Continued)

(56) References Cited

U.S. PATENT DOCUMENTS 276,901 A * 5/1883 Seely ..... 5/237
1,333,119 A * 3/1920 Krag-Moller ..... 310/75 R
(Continued)

FOREIGN PATENT DOCUMENTS

DE 199 12 916 A1 9/2000
EP 1 159 947 A2 12/2001
WO WO 2005/079724 A1 9/2005

OTHER PUBLICATIONS

International Preliminary Report on Patentability for PCT Application No. PCT/DE2010/000956, dated Mar. 6, 2012, 2 pages.
(Continued)

*Primary Examiner* — Robert G Santos
*Assistant Examiner* — Myles Throop
(74) *Attorney, Agent, or Firm* — Westman, Champlin & Koehler, P.A.

(57) ABSTRACT

The invention relates to a bed for providing support in sitting up to a person lying thereon, comprising an approximately rectangular frame, which comprises at least two frame parts, which are separated from each other in the longitudinal direction and are connected to each other in an articulated manner and are completed to form a planar element by flexible slats, woven wire fabric, or the like and can be swiveled about a transverse axis oriented transversely to the respective frame part from the horizontal to an inclined position, wherein at least one sit-up area lies on at least one frame part, said sit-up area being integrated into the surface of the frame part in the deactivated state, the outward-facing edge of said sit-up area extending approximately to the border of the frame and the inward-facing edge of said sit-up area being at a distance from the center line of the frame extending in the longitudinal direction, wherein said sit-up area can be swiveled about a sit-up axis extending parallel or at an angle to a longitudinal side of the frame in order to activate the sit-up area.

20 Claims, 2 Drawing Sheets

(58) Field of Classification Search
USPC ..... 5/607, 609, 612–161, 619, 621, 633–634,5/927
See application file for complete search history.

(56) References Cited

U.S. PATENT DOCUMENTS

| | | | | |
|---|---|---|---|---|
| 2,250,026 | A * | 7/1941 | Laukhuff | 5/634 |
| 3,211,495 | A * | 10/1965 | Nielsen | 297/68 |
| 3,875,598 | A * | 4/1975 | Foster et al. | 5/607 |
| 4,654,907 | A * | 4/1987 | Haugaard | A45C 3/10 297/17 |
| 5,224,228 | A * | 7/1993 | Larrimore | 5/613 |
| 5,500,964 | A * | 3/1996 | Bergersen | 5/607 |
| 5,826,286 | A * | 10/1998 | Cranston | 5/606 |
| 6,687,932 | B1 * | 2/2004 | Bangert et al. | 5/617 |
| 7,237,286 | B1 | 7/2007 | Kim | 5/613 |
| 7,246,389 | B2 * | 7/2007 | Taguchi et al. | 5/618 |
| 7,893,551 | B2 * | 2/2011 | Dai | 290/1 C |
| 8,776,290 | B2 * | 7/2014 | Wilkinson et al. | 5/615 |
| 2005/0160530 | A1 * | 7/2005 | Taguchi et al. | 5/618 |
| 2005/0273926 | A1 * | 12/2005 | Sharps et al. | 5/81.1 R |
| 2007/0169266 | A1 * | 7/2007 | Kim | 5/607 |
| 2007/0220677 | A1 * | 9/2007 | Dewert | 5/618 |
| 2009/0077748 | A1 * | 3/2009 | Kim | 5/613 |
| 2009/0094746 | A1 * | 4/2009 | Ferraresi et al. | 5/609 |
| 2010/0275376 | A1 * | 11/2010 | Benzo et al. | 5/618 |
| 2012/0297543 | A1 * | 11/2012 | Robertson | A47C 20/041 5/616 |

OTHER PUBLICATIONS

Written Opinion for the International Searching Authority for PCT Application No. PCT/DE2010/000956, dated Dec. 9, 2010, 5 pages.
International Search Report for corresponding PCT Application No. PCT/DE2010/000956, dated Dec. 9, 2010, 2 pages.

* cited by examiner

BED FOR PROVIDING SUPPORT IN SITTING UP

CROSS-REFERENCE TO RELATED APPLICATION

This Application is a Section 371 National Stage Application of International Application No. PCT/DE2010/000956, filed Aug. 12, 2010 and published as WO 2011/023161 A1 on Mar. 3, 2011, in German, the contents of which are hereby incorporated by reference in their entirety.

FIELD

Embodiments of the invention relate to a bed for supporting the raising of a person lying thereon, comprising an approximately rectangular frame, which comprises at least two frame parts, which are separated from each other in the transverse direction and are connected to each other in each case in an articulated manner and are completed to form a planar element by means of spring strips, woven wire fabric, or the like and can be pivoted about a transverse axis oriented transversely to the respective frame part from the horizontal to an inclined position.

BACKGROUND

For persons who lie on a planar surface, it is widely known and conventional to lift the head and torso temporarily from the horizontal position by pushing objects such as pillows beneath the head or else beneath the torso. In more comfortable variants the upper portion of the bed frame can be lifted for this purpose. Thus, German patent DE 1 9 1 40 describes a bed, the upper frame portion of which can be pivoted about an axis oriented transversely to the longitudinal direction of the bed. The special feature in this case is that, by means of a hydraulic pump and a hydraulic cylinder, the upper frame portion can be lifted by the reclining person himself into an inclined position.

With the much larger number of adjustment possibilities, German patent 94 07 424 T2 describes a bed for the hospital sector, which is subdivided along its length into numerous transversal sections, which can be adjusted in their level and inclination. In addition, the adjustment elements are arranged in two groups on a carriage, which is displaceable in the longitudinal direction on an overall frame.

In particular with very aged people or patients with restricted mobility—for example with muscle shrinkage or other weakening—the lifting of the head and torso by pivoting the upper frame portion about a transverse axis leads to the head, or even the trunk sliding to the longitudinal side of the bed. In an extreme case, the caregiver must intervene manually to prevent the patient falling laterally out of the bed.

Because the caregiver actuates the adjustment mechanism of the upper frame portion with one hand, only one hand is available for supporting the patient. If this hand does not lie with its entire surface of the patient, then, in the case of patients with ageing or weakening connective tissue, this may lead to haematomas.

The effect of lateral rolling off is readily understandable by considering, instead of the patient, a cylindrical body without any drive, which is mounted on the upper frame portion in the longitudinal direction. If, due to lifting of the upper frame portion, an oblique plane is crated, the cylindrical body must be oriented with high precision exactly perpendicularly to the transverse axis about which the upper frame portion is pivoted. If the cylindrical body deviates only slightly from this exact perpendicular, then, due to the lifting on the oblique plane, a force component is produced that is oriented transversely to the longitudinal axis of the cylindrical body and moves it in a lateral direction. If the cylindrical body starts to roll, then the force acting laterally on it is increased and moves the cylindrical body away from a perpendicular towards the pivot axis, as a result of which the transversely-directed force further increases, so that the cylindrical body rolls off laterally.

During raising of the upper frame portion, the torso lying thereon is thus in an unstable position. Normal people, or at least people of restricted mobility, can compensate for the transverse force caused thereby, so that they remain on the upper frame portion. However, that is impossible for people with back muscles lastingly weakened by age or illness.

The same applies to a lower frame portion that has been pivoted to an inclined position in order to lift a patient's legs. In this case, too, forces oriented transversely to the leg are exerted if the leg is not oriented very precisely perpendicular to the pivot axis of the lower frame portion. These transverse forces can force a person of very greatly handicapped motor functions outwards and out of the bed.

SUMMARY

Against this background, it is the object of embodiments of the invention to develop a support that, on pivoting of a portion of the frame about a pivot axis oriented transversely to the longitudinal axis of the bed, prevents the lateral rolling off of the torso or of another body part of persons reclining on the bed and supports the standing up out of bed, the springing of the bed being uniform as possible over its entire surface.

As a solution, embodiments of the invention teach that, on at least one frame portion, there lies at least one raising region, which, in the deactivated state, is integrated in the surface of the frame portion, and of which the outwardly facing edge extends approximately as far as the edge of the frame, and of which the inwardly facing edges is spaced from the center line of the frame running in the longitudinal direction and which, for activation, is pivotable about a raising axis running parallel to or obliquely to a longitudinal side of the frame.

One characterizing feature of the invention is thus that at least one portion of an—inclinable—frame portion, a raising region, is additionally pivotable about an axis oriented in the longitudinal direction of the bed. Such a raising region is arranged on at least one longitudinal side of an upper frame portion or on both longitudinal sides. If both raising regions have been raised, then, together with the center portion of the frame portion, form a trough-like element that reliably prevents the torso of a person lying thereon rom sliding off laterally.

It is a particular feature of the invention that, on all frame portions, the raising regions always leave free a central strip that is then pivotable about an axis. In the transverse direction of the bed, the central strip is always horizontal, so that, even with extreme pivoting of the bodies on the central strip, a secure contact takes place. On the frame portions and the raising regions, there approximately lies a mattress, which is also so flexible in the transverse direction that it follows all the pivotings.

A bed according to the invention has, in a very simple case, only one pivotable frame portion in the transverse direction, and the rest of the frame is immobile. However, also possible are three or more frame portions, such as an upper frame portion for head and back, a center frame portion for the buttocks and a lower frame portion for the legs. For the sake of clarity, the simple example of a pivotable upper frame portion will be described below.

If a person lying in bed is to be raised by lifting the upper frame portion, and in the process threatens to slide off laterally, then the raising portion located at this side will be lifted at its outer edge and thereby holds back the patient in the center of the upper frame portion. If the second raising region has also been raised, then the patient's head and torso can also not slide off towards this side. A reliable raising of a reclining person is thereby achieved.

For supporting a person in standing up from the reclining posture, the upper frame portion is also folded up. In addition, the raising aid at the edge opposite the leaving side is lifted. The person will be additionally lifted at his body edge lying on the raising region, and thereby pivoted about his longitudinal axis, which is an indispensable operation for getting up out of bed. If the upper frame portion is pivoted close to the perpendicular, then the torso of the person to be raised, too, is also in an almost perpendicular posture. The final pivoting of the torso through a few degrees to the perpendicular is then even possible for weakened and handicapped persons, who can still keep upright independently out of bed.

In the next step, only the legs, which are also pivoted by the pivoting movement of the torso, must be brought into a raised position. To this end, the calves are pushed out of bed until they hang down vertically from the bed edge.

Ideally, the maneuvering out of the calves from the reclining position should be performed synchronously with the raising of the torso so that the risk of injury for the patient is minimized.

The final raising of the person standing up into the vertical position can be effectively supported by lifting the entire bed.

In the practical embodiment, it is to be preferred that the sitting up region extends as far as the longitudinal side and also as far as the transverse side of the upper frame portion. The advantage of this embodiment is that, in the activated state of the raising region, a mattress lying thereon is supported over its entire surface.

However, it is also possible that the raising region is smaller and does not extend as far as the outer edges of the upper frame portion. An advantage of such a variant may be that the frame of the upper portion and of the raising region are not arranged one on top of the other but side by side, so that the constructional height of the entire frame construction is smaller.

For the practical execution of the raising region, the invention describes two fundamentally different variants.

The first variant relates to bed frames that bear transversely extending, horizontal spring strips, on which the mattress lies.

For this configuration, it is conceivable, with respect to the geometry, for the upper frame portion to be subdivided into three portions, which are in each case surrounded by a surrounding frame. The mutually adjoining frames of the raising portion and the center piece of the upper frame portion are connected together by hinges and in this way can be pivoted with respect to one another.

The decisive disadvantage of this configuration, however, is that the frame extending in the longitudinal direction affects the spring comfort of the bed in the long term, which, particularly in the case of very sensitive senior citizens or in the case of ill people can lead to unpleasant pressure points and immediately to sores (pressure ulceration).

To avoid this effect, it is state of the art in beds of the prior art for the frame to extend in the exterior region of the lying surface, where it is used not for constant reclining but only briefly during raising and during sitting, in which its relative hardness is highly welcome. In the actual reclining region, however, permanently elastic spring strips are installed in the transverse direction in the frame. Due to their elasticity, they comply more or less to the weight of the body bearing thereon, so that, in the case of regions with relatively high spot loading—such as in the buttocks region—the pressure on the skin does not rise overproportionally, but, due to the compliance of the spring strip, is adjusted to the mean value of the pressure on the other skin parts.

In a similar way, the pressure on the back of the head and shoulders is adjusted by corresponding further compliance of the spring strip supporting them. This spring effect cannot be restricted by the raising region lying thereon. The invention therefore proposes that the surface of the raising region is formed by a plurality of short strips, which in each case lies on one of the existing spring strips. These short strips are articulately connected to the spring strip at their inner end along the raising axis, and to an additional longitudinal strip at their other end.

If the short strips are only connected at one point to the spring strips extending over the entire width of the frame, they do not restrict the elasticity in the center region of the upper frame portion. Only for the raising region itself is the elasticity reduced somewhat by the short strips lying thereon, for which reason the short strips should also be inherently elastic.

The short strips are in practice always alighted perpendicular to the longitudinal strip, so that the entire structure, consisting of a longitudinal strip and a plurality of short strips running perpendicular thereto, has the silhouette of a comb. This stricture is articulatedly connecte at the ends of the tines of the comb to the long spring strips of the upper frame portion, which lie beneath.

All joints are flush with one another and in their entirety form the raising axis of the raising region. So as not to restrict the reclining comfort, the joints should be relatively low profile, that is to say consist of sections of a textile material, which is fastened at one half on the spring strip and at the other half to the free end of the short strip.

If, on adjoining frame parts, the raising regions are rectangular and have a common raising axis—that is to say a common pivot axis—and if the frame parts are pivoted with respect to one another and at the same time the raising regions are raised with the same angle, then the raising regions collide with one another.

In order to avoid that, the raising regions are, in the simplest case, "chamfered" at their adjoining edges. That is to say, instead of a rectangular outline, they then have a trapezoidal outline. Then the adjacent raising regions are pivoted with respect to one another without running into one another.

The support for the mattress that is then lacking at the chamfered corners is usually compensated, even partially, by the mattress itself. If, however, this compensation is too low, then the longitudinal strip can alternatively be telescopically shortened and a short strip fastened thereon in an articulated manner, which at the other end is also connected at the other end movably the spring strip. These connections, which are articulated in two directions, must additionally also permit extension in the longitudinal direction, since the short strip is made "oblique" by the telescopic shortening of the longitudinal strip.

Such a connection is also made possible by permanently elastic plastic elements. A reinforcement by textile fabric or fibers increases the lifetime.

In a stationary state, the longitudinal strip of each raising region lies on the frame of the upper frame portion or in the region thereof and is at least approximately flush with the longitudinal side of the bed. To activate the raising aid, the longitudinal strip of the upper frame portion is lifted, as a result of which the short strips are pivoted into an oblique position. The portion of the mattress lying thereon then forms an inclined surface and as a result is pivoted about a longitudinal axis with respect to the center region of the upper frame portion.

In a similar manner to the way that the springing at the transition point from the raising region to the frame portions must be retained, they must also continue uniformly at the boundary from one frame portion to the next along the entire frame. It is particularly unbearable for bed-bound patients if, at these points, the sections of the frame extending transversely over the bed press into their body with elevated pressure. The consequence would soon be sores.

Therefore, with mutually adjoining frame portions, the transversely extending sections of the frame portions, which are mutually contacting when the frame is in a horizontal position, are disposed below the surface of the frame. To be able to satisfy this requirement, these sections can be, for example, U-shaped. Only the ends of the two legs of the U are connected to the longitudinal strips.

As an alternative to the spring strips, beds are known, the springing of which consists of numerous vertically disposed spring elements, such as the helical springs known colloquially as coil springs. These vertical spring elements are arranged in planes, which can be realized in practice by means of a plate, however in practice they can be executed as a mesh to improve the ventilation.

In this variant—unlike the design with spring strips—it is very suitable in practice to subdivide the upper frame portion into three framed regions, which are in each case connected together in an articulated manner. These joints are arranged along the raising axis. In contrast to the variant with the spring strips, these components do not disturb the reclining comfort in the permanently reclining area, since they are separated from the mattress by the vertical spring elements. In this embodiment, too, the raising region, in its deactivated state, lies on the upper frame portion. For activation, it is lifted in the region of the longitudinal side of the frame, and then forms an inclined plane.

If the raising portion is inclined with respect to the surface of the upper frame portion, then the vertical spring elements are also thereby inclined. As a result, at the boundary between the central region of the upper frame portion and the raising portion, the upper ends of the vertical spring elements migrate closer together. However, this movement cannot be executed by the mattress lying on the vertical spring elements, since it is almost impossible to push them one into the other. The mattress is such a configuration will therefore usually slide on the top side of the vertical spring elements.

Depending on the design of the boundary region between the underside of the mattress and the top side of the vertical spring elements, some of the vertical spring elements might, for example, sink into the flexible mattress, however, with an increase of the forces acting on them, suddenly be released from this connection, as a result of which, noises might suddenly occur, which might irritate the reclining person.

The invention therefore recommends, in the region of the raising aid, and in the adjacent region of the upper frame portion to connect together the vertical spring elements at their upwardly facing end by means of tension-pressure rods. It is thereby prevented that the upper ends of the vertical spring elements can shift with respect to the mattress. In the case of a raising of the raising region, the surface between two adjacent vertical spring elements is then transformed from a rectangle to a parallelogram.

The vertical spring elements can—as already mentioned—be helical springs of metal or else of plastic. Since they can be slightly curved in their longitudinal axis, it is possible without significant disadvantages to connect them firmly to the raising region or to the upper frame portion. Alternatively, the vertical spring elements can consist of block-like elements, such as foamed plastic. Since, in their longitudinal axis, they can only be bent with increased force application, the invention recommends connecting them in an articulated manner to the raising region or the upper frame portion.

As a further alternative to a framework consisting of a longitudinal strip with a plurality of short strips or a mesh with a plurality of vertical spring elements, the raising region can also be embodied as an air cushion. This air cushion is inserted between the upper frame portion and the mattress in the raising region. It can be inflated and then assumes a triangular profile in the transverse direction.

So that the top side of the air cushion is not curved upwards as a mound, even with partial filling, a strengthening of the top side of the air cushion by rods or a mesh or a plate.

However, if the step in the mattress is not desired, it is conceivable as an alternative for the raising axis not to run parallel to the longitudinal side but at an acute angle. In an appropriate variant, the raising axis then extends from a mattress-side corner of the upper frame portion approximately as far as the center of the free end corner of the upper frame portion. In this case, the base surface of the raising region is triangular. If only one raising surface on the bed frame is raised, the lateral edge of the mattress runs horizontally and only rises in a ramp-like manner in the head region. The face edge of the mattress also runs horizontally on at least one half and rises obliquely as far as the raised corner.

In the simplest variant, in which the raising region is formed by spring strips or a mesh, it can be manually lifted and fixed by means of a detent lever. If this lever has a plurality of detents, the raising region can also be fixed in various positions. The hardware necessary for this is known in a multiplicity of variants for raising the head and foot portions of bed frames.

Another inexpensive and proven alternative is a spindle drive, which is manually actuated by means of a hand crank. The spindle drive can be, for example, the horizontal diagonal of four rods connected together in an articulated manner which can raise and lower a frame portion or a raising region according to the principle of the known scissor-action car jack.

Alternatively, the sitting up region can also be fixed in various positions by means of a motor drive. In the prior art, rotating electric motors are known for this purpose, which execute a linear movement via a gear mechanism and spindle. Alternatively, a pneumatic cylinder or a hydraulic cylinder is also conceivable as drive. The work of this drive can be reduced by means of a gas pressure damper or a pretensioned spring parallel to the drive. The gas pressure damper or the springs then serve as weight compensation for the masses to be raised.

With a motor drive it should then be noted, besides the necessary investment costs, that it requires an energy supply to operate. For emergencies or for use in regions without supply networks, the drive can also be supplied from an energy accumulator, which can be charged by the person in bed by means of a pivotable lever.

Persons handicapped in their movement scope or generally weakened nevertheless require regular physical training so as not to fall into the vicious cycle of a further weakening of their locomotor system and the resulting increased need for care. It is therefore also appropriate for this group of persons to apply the energy required for raising themselves. The movement energy here can either be directly used for raising the raising region or supplied to an accumulator, from which it can be called up again at a subsequent time point via a control element. As control elements, buttons may be used which are disposed in a control panel. They can be realized as a control panel with a fixed connection to the bed or one that is connected by cable or wirelessly.

A bed according to the invention, in the most general case, can be equipped with only one raising region on one longitudinal side of an upper frame portion. Naturally, the variant with two raising regions on each longitudinal side of the upper frame portion is more advantageous. Maximum operator comfort and maximum functionality is achieved when the two raising regions can be raised by means of a drive in each case. To reduce the investment costs, however, it is also conceivable that a single drive can optionally be coupled to one or the other raising region. This can be executed, for example, by means of remote controllable couplings. However, in many, cases these are almost as complicated as a drive itself. An actual cost saving is only achieved if the remote-controllable coupling is replaced by the alternate manual creation of a mechanical connection, that is to say the drive must be released and connected to the raising region or to the other raising region.

By this means a bed according to the invention, which has the mechanism for two raising regions, but only a single drive, can still be adapted to the condition of the respective set up. If the mechanical conversion of the drive is so simple that it can be performed by the user or at least by a carrier, but an added value for the use is still generated thereby. If the raising region is required for raising a person during getting up out of bed, it is appropriate, for example, to activate the raising region close to the wall. With a conversion of the bed, the other raising region of the bed can be activated instead with reasonable effort.

A raising aid according to the invention on an upper frame portion can support a person reclining in the bed with two operations: The first operation is raising the torso. To this end, the upper frame portion is pivoted and at the same time at least one raising portion is raised. The person is thereby prevented from sliding off the upper frame portion sideways.

The second application area is support in leaving a bed. That is particularly effective if the bed not only has an upper frame portion but also a center frame portion and a lower frame portion, which are all equipped with a setting up region in each case. Ideally, the person to be raised reclines with one arm and one partial region of their torso and one buttock-half and one leg in each case on a raising region, is thus pushed somewhat out of the longitudinal axis of the bed onto the raising regions. Then, during raising of the upper frame portion, the setting up aids opposite the exit side are also moved out of the horizontal into an inclined position. Then the torso and the buttocks of the person is not only pivoted out of the horizontal into an almost perpendicular position, but additionally also rotated so that it pivots towards the intended exit side.

By means of the inclined raising region on the lower frame portion, the legs, too, are displaced towards the outer side of the bed. Ideally, to this end, the lower frame portion is also lowered.

Then it is very much simpler for the affected person himself or for the caregiver to convey the feet out of the bed so that they can be placed on the floor surrounding the bed. The last step of leaving bed is facilitated by raising the bed.

DETAILED DESCRIPTION OF ILLUSTRATIVE EMBODIMENTS

Figure 1:
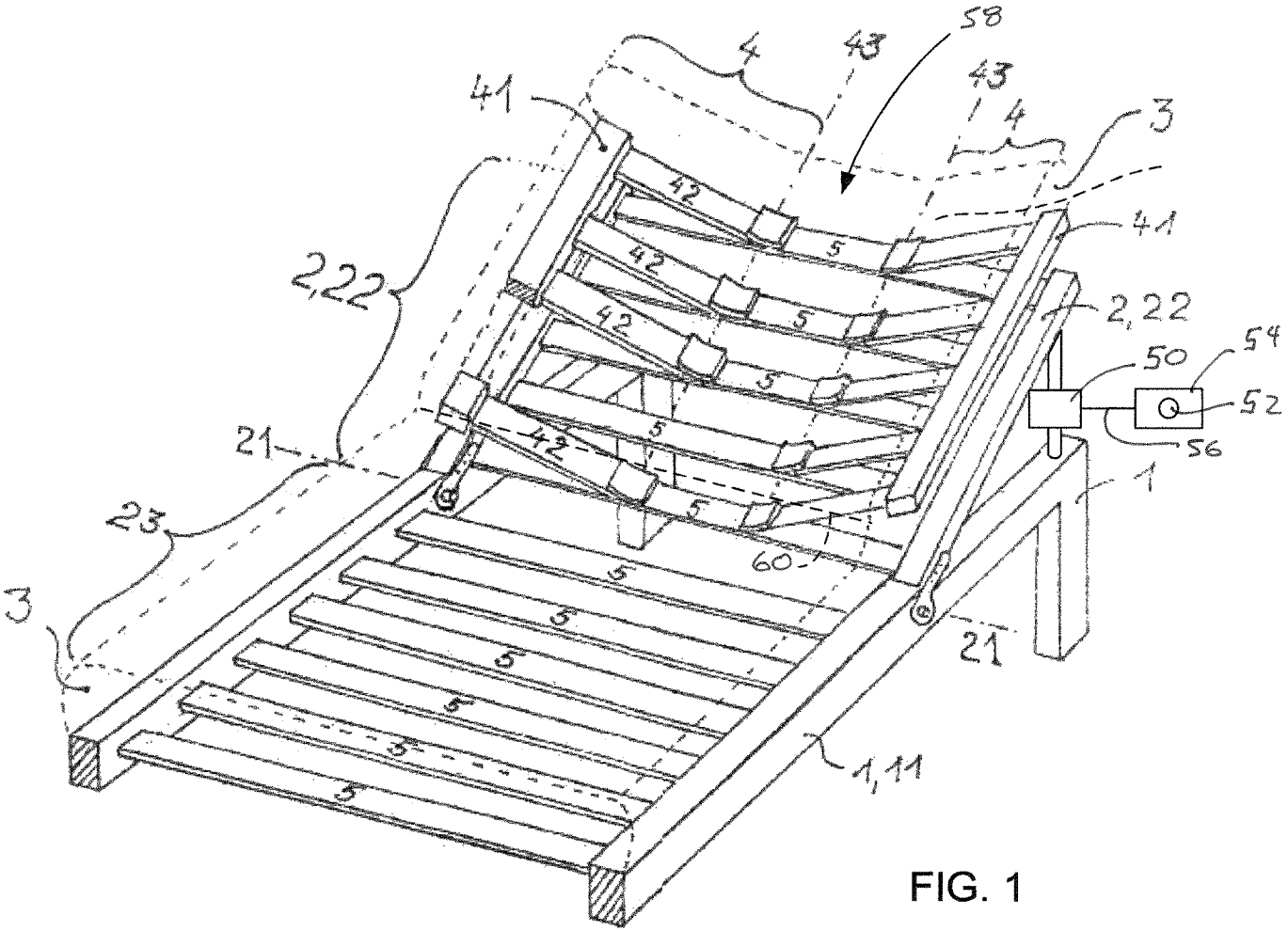
FIG. 1 shows schematic view of a portion of a bed with an upper frame portion and two raising regions on an upper frame portion.

FIG. 1 shows a bed according to the invention in a very simple embodiment with pivotable upper frame portion 22 and, thereon, two raising regions 4, wherein only the—in this case fixed—center frame portion 23 for support of the buttocks of a reclining person and the upper frame portion 22 for support of the torso and head are shown. The center frame portion 23 and the upper frame portion 22 are separated from each other in the longitudinal direction of the bed.

In the center frame portion 23, it can immediately be recognized that it is not an adjustable portion of the frame 1. In the variant described here, spring strips 5, which extend transversely to the bed, are provided as resilient element between the two longitudinal sides 11 of the frame 1. In the region of the bed shown, the upper frame portion 22 is likewise provided, with spring strips 5, which are oriented transversely to the bed.

In FIG. 1, the upper frame portion 22 is inclined so that the support for the torso and the head is inclined. To this end, the upper frame portion 22, in the state shown in FIG. 1, is pivoted about the transverse axis 21. A strut or a motor drive, represented at 50, with which the upper frame portion 22 has been pivoted into the inclined position and held there, is illustrated in FIG. 1. In some embodiments, the motor drive 50 is configured to fix the raising region 4 at various positions. In some embodiments, the motor drive 50 is an electric motor, a pneumatic cylinder, a hydraulic cylinder, a bas pressure damper and/or a pretensioned spring. In some embodiments, the motor drive 50 is activated by pushing a button 52 on a control panel 54, which are illustrated schematically in FIG. 1. In some embodiments, the control panel 54 is fixed to the motor drive 50. In some embodiments, the control panel 54 is connected to the motor drive 50 through a connection 56, which may be a cable or a wireless connection.

In FIG. 1, it can very readily be seen that the upper frame portion 22 is equipped with two each of so called "raising regions 4". In this case, they are two rectangular sections on those edges of the upper frame portion 22 that face in the longitudinal direction. Both raising regions 4 are pivoted about the raising axis 43 in the longitudinal direction of the bed, so that the upper frame portion 22 in this state is shaped as a large channel with a central portion 58 extending generally between the axes 43.

Each raising region 4 consists of the short strips 42, which in the raising axis 43 are connected in an articulated manner to the spring strips 5 of the upper frame portion 22. In this exemplary embodiment, the connections are low-profile elastic elements, such as a textile material, so that the articulated connections do not result in pressure points in the body of the person lying thereon through the mattress lying thereon.

The spring strips 5 of the upper frame portion 22 are extended via the short strips 22 into the raising region 4. The short strips 42 of a raising region 4 are in each case held together by a longitudinal strip 41, which extends transversely thereto, and, when the raising region 4 is in the deactivated state, lies on that section of the upper frame portion 22 which extends along the bed.

FIG. 1 shows, for both raising regions 4, the activated state in which the longitudinal strips 42 are raised from the upper frame portion 22. The setting-up mechanism for this is now shown in FIG. 1 for the sake of clarity.

In the raising region 4 shown at the left, the longitudinal strips 41 is shown cutaway and the short strip 42 connected thereto has been removed, to that the continuous spring strip 5 of the upper frame portion 22 beneath it can be seen.

A mattress 3 lies on the entire illustrated region, that is to say on the two raising regions 4, the free regions of the spring strips 5 that lie in the central region of the upper frame portion 22, and the central frame portion 23 of the frame 1. The mattress is shown In FIG. 1 by means of a broken line. It is readily visible in FIG. 1 that the mattress 3 flexibly conforms to the contour of the raising regions and the upper frame portion. To this end, it must be appropriately elastic and must not exceed a certain material thickness.

If the region of the mattress 3 on which the torso and the head lie pivoted about the longitudinal axis of the bed, and thereby the raising region is inclined transversely to the bed, a step is thereby formed on the respective longitudinal side of the bed. If the mattress 3 is very thin or particularly flexible, it can at least approach this step form. If, however, the mattress 3 is very thick and cannot follow this step form, the invention recommends, cutting the mattress at the limit between the raising regions 4 of the upper frame portion 22 and the central frame portion 23, as indicated at line 60 in FIG. 1, resulting in an exact step at the longitudinal side during raising of the raising region 22 of the upper frame portion 22. Because the perpendicular walls of the mattress are thereby exposed in the region of the cut 60, the cover of the mattress must be so elastic that it can also cover this step. Otherwise the cover of the mattress must also be cut at the boundary between the raising region and the central portion and a cover of the perpendicular walls of the cut be sewn on the cut edges. An advantage is that a clear step thereby develops. This step can also offer an additional functional benefit: If the torso of the reclining person is lifted by raising the raising region, then a small gap forms in the central region between the body and the mattress. It can be used for sliding a plate-like tool beneath the person, which can be used to move or to turn over a person who can no longer move through his own strength.

In FIG. 1, it is readily visible that the torso and the head of a person lying in the trough-like region or central portion 58 on the upper frame portion 22 cannot slide of sideways during raising of the upper frame portion 22, but is held in the central portion 58 of the upper frame portion 22 due to the inclination of the two raising regions 4.

In FIG. 1, it is also readily comprehensible that, due to the raising of only one raising region 4 with the other raising region 4 lying flat, the raising of a person who has hardly any mobility left can be helpfully supported. If the torso of the person partly lies on the raising region 4, then, during raising of the raising region 4, it is lifted off the upper frame portion 22, as a result of which the person is pivoted about his longitudinal axis. At the same time, with the raising of the upper frame portion 22, the person is thereby brought into a virtually seated position, in which he its oriented almost parallel to the longitudinal side 11 of the bed. Thanks to the raising aid, the rotation of the person through 90 degrees is expressly supported within the bed before getting up.

Figure 2:
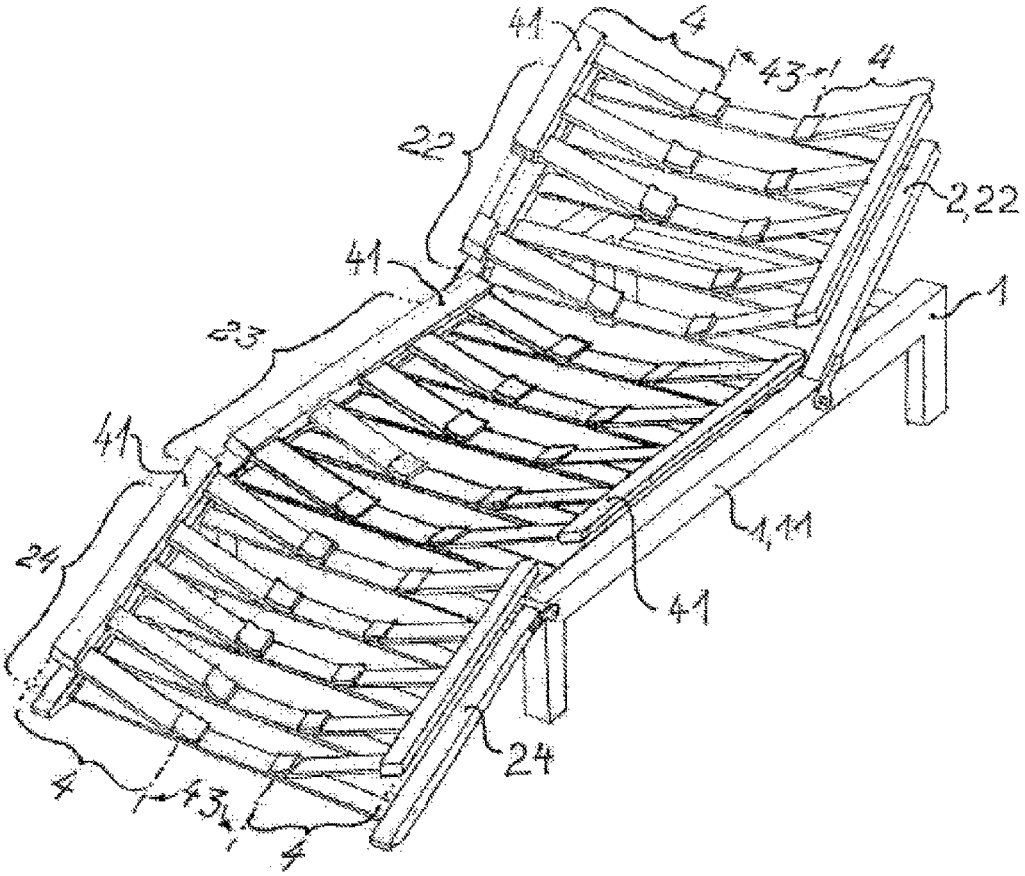
FIG. 2 shows a schematic view of a bed as in FIG. 1, but with two raising regions on the center frame portion and a pivotable lower frame portion with two further raising regions.

In FIG. 2, the bed, which is shown in FIG. 1, is extended with further pivotable frame portion 2, namely a lower frame portion 24, with which the legs of the person lying thereon can be raised and lowered.

Here, too, the—in this case fixed—center or central frame portion 23 is equipped with two raising regions 4 for supporting the buttocks.

For the sake of clarity, the eight drives and their force transmission and supports for pivoting and fixing of the two frame portion 2 and the six raising regions 4 are not shown in FIG. 2.

In FIG. 2, it can be readily seen how, in this embodiment with raising regions 4 along both longitudinal sides 11 of the frame 1, a channel-like depression results, which also keeps a completely helpless person safely in the center during pivoting of one or more frame portions 2, and stops them falling out.

As a further advantage, it becomes clear that a "center strip" nevertheless remains, which is pivoted in only one direction. This center strip offers a sufficiently large support surface for the back, buttocks and legs, so that the body weight is uniformly distributed. By this means, excessive pressure on narrowly limited body regions, and therefore the risk of pressure ulceration, is limited.

Nevertheless, the reclining person can thereby be pivoted about his longitudinal axis during raising of the raising regions along only one longitudinal side. That can be desirable, for example for changing position. Or it may be necessary for diagnosis or for therapy.

However, this position is also helpful as an intermediate stage in the process of getting up. Together with a pivoting of the upper frame portion 22 and the lower frame portion 24, the most difficult phase of getting up is thereby possible almost without any help from the patient, and thus enables handicapped persons, who can still raise them up from the bed, which is a very great improvement of their quality of life.

Of course, comfort in bed and during getting up is also increased for only temporarily sick or for healthy persons.

Although the present disclosure has been described with reference to one or more examples, workers skilled in the art will recognize that changes may be made in form and detail without departing from the scope of the disclosure and/or the appended claims.

LIST OF REFERENCE CHARACTERS

1 Frame
11 Longitudinal side of frame 1
12 Centre line in the longitudinal direction of the frame 1
2 Frame portion of the frame 1
21 Transverse axis that is pivotable about each frame portion 2
22 Upper frame portion, back and head region, a frame portion 2
23 Centre frame portion, buttocks region, is a frame portion 2

24 Lower frame portion, leg region, is a frame portion 2
3 Mattress, lying on frame 1
4 Raising region of the upper frame portion 2
41 Longitudinal strip, connected to all short strips 42 in the raising region 4
42 Short strip in the raising region 4, lies on a spring strip 5
43 Raising axis around which the raising region 4 is pivotable
5 Spring strips in the upper frame portion 2

The invention claimed is:

1. A bed for providing raising support to a person lying thereon in a longitudinal direction, comprising:

an approximately rectangular frame extending in the longitudinal direction and including at least a first frame portion and a second frame portion, which are separated from each other in the longitudinal direction and are connected to each other in an articulated manner, each of the first and second frame portions having a width measured in a widthwise direction that is perpendicular to the longitudinal direction wherein:

each of the first and second frame portions includes spring strips or woven wire fabric extending between opposing sides of the frame portion;

each of the first and second frame portions can be pivoted about a transverse axis, which is transverse to the longitudinal direction, relative to the other frame portion; and a first pair of raising regions attached to the first frame portion, and a second pair of raising regions attached to the second frame portion and disconnected from the first pair of raising regions, each of the raising regions is less than one half of the width of the attached frame portion, and the raising regions of each of the first and second pairs of raising regions are positioned on opposing sides of a center line of the attached frame portion and extend in the longitudinal direction, wherein each of the raising regions is pivotable about a raising axis that extends parallel or obliquely to the center line and is displaced from the center line, has an outwardly facing edge extending in the longitudinal direction that extends to an edge of the attached frame portion, and an inwardly facing edge extending in the longitudinal direction that is spaced from the center line.

2. The bed according to claim 1, wherein at least one mattress lies on the frame.

3. The bed according to claim 1, wherein the first and second frame portion include at least two of:

an upper frame portion for supporting the back and head regions;

a center frame portion for supporting the buttock region; and a lower frame portion for supporting the leg region of the person reclining thereon.

4. The bed according to claim 1, wherein the spring strips of each of the first and second frame portions extend transversely to the longitudinal direction and are disposed below a surface of the frame when the frame is in the horizontal position.

5. The bed according to claim 4, wherein the mattress lies on the first and second frame portions and the first and second pairs of raising regions.

6. The bed according to claim 5, wherein the mattress is cut at a boundary between the first and second frame portions.

7. The bed according to claim 6, wherein the mattress is encased in a cover.

8. The bed according to claim 1, wherein:

at least one of the first and second frame portions includes a plurality of the spring strips;

at least one of the raising regions includes a longitudinal strip extending in the longitudinal direction; and the bed comprises a plurality of short strips, each having a first end connected to one of the spring strips and a second end attached to one of the longitudinal strips, wherein the raising axis is located adjacent the first ends of the shorts strips.

9. The bed according to claim 1, wherein each of the raising regions, can be fixed at various portions by means of a motor drive.

10. The bed according to claim 9, wherein the motor drive includes at least one of:

an electric motor,
a pneumatic cylinder,
a hydraulic cylinder,
a gas pressure damper, and
a pretensioned spring.

11. The bed according to claim 9, wherein the motor drive can be activated by pushing a button on a control panel that is one of:

fixed to the motor drive,
connected to the motor drive through a cable, and
configured to communicate wirelessly with the motor drive.

12. The bed according to claim 1, further comprising a motor drive, which is optionally coupled to at least one of the raising regions.

13. The bed according to claim 12, wherein an assignment of the drive to one or both raising regions of the first or second pairs of raising regions can be alternated by changing a mounting of the drive or a transmission element between the drive and raising regions.

14. A method for raising a person in a bed according to claim 1, wherein, before or during raising of the upper frame portion, at least one raising aid is also moved from a horizontal position to an inclined position.

15. A method for leaving a bed according to claim 1 by a person reclining thereon, wherein, before or during raising of one of the first and second frame portions, a raising aid that is opposite an exit side is moved from a horizontal position to an inclined position.

16. The bed according to claim 1, wherein the first and second pairs of raising regions do not extend beyond the corresponding attached frame in the widthwise direction or in the longitudinal direction.

17. The bed according to claim 16, wherein each raising region has a raised position, in which the outwardly facing edge is displaced from a corresponding edge of the attached frame portion, and a deactivated state, in which the raising region is integrated in a surface of the attached frame.

18. The bed according to claim 1, wherein at least one of the raising regions includes telescopically retractable longitudinal strips.

19. The bed according to claim 1, wherein at least one of the raising regions includes chamfered edges.

20. The bed according to claim 1, wherein:

the first frame portion is pivotably attached to the second frame portion; and the frame includes a third frame portion that is pivotably attached to an opposing side of the second frame portion from the first frame portion, the third frame portion including spring strips or woven wire fabric extending between opposing sides of the third frame portion.

* * * * *